US009003665B2

(12) United States Patent
Pelton

(10) Patent No.: US 9,003,665 B2
(45) Date of Patent: Apr. 14, 2015

(54) IDENTIFICATION TAG WITH BREAKAWAY TOOL

(75) Inventor: Robert Young Pelton, Bonsall, CA (US)

(73) Assignee: DPX Ventures Limited, Ras Al Khaimah (AE)

( * ) Notice: Subject to any disclaimer, the term of this patent is extended or adjusted under 35 U.S.C. 154(b) by 204 days.

(21) Appl. No.: 13/523,844

(22) Filed: Jun. 14, 2012

(65) Prior Publication Data

US 2012/0317819 A1 Dec. 20, 2012

Related U.S. Application Data

(63) Continuation-in-part of application No. 13/400,535, filed on Feb. 20, 2012, now Pat. No. 8,707,490, which is a continuation-in-part of application No. 13/312,965, filed on Dec. 6, 2011, now Pat. No. 8,695,138.

(60) Provisional application No. 61/496,602, filed on Jun. 14, 2011.

(51) Int. Cl.

| | |
|---|---|
| ***B25F 1/00*** | (2006.01) |
| ***B26B 9/00*** | (2006.01) |
| ***B26B 11/00*** | (2006.01) |
| ***B26B 9/02*** | (2006.01) |

(52) U.S. Cl.
CPC . *B25F 1/006* (2013.01); *B26B 9/00* (2013.01); *B26B 9/02* (2013.01)

(58) Field of Classification Search
CPC ..... B25F 1/00; B26B 11/00; A47G 21/00; A47G 21/02; A47G 21/06
USPC ..... 7/138, 148, 156, 158; 30/123, 142, 144
See application file for complete search history.

(56) References Cited

U.S. PATENT DOCUMENTS

| | | | |
|---|---|---|---|
| 1,455,621 | A | 5/1923 | Joyner |
| 2,315,898 | A | 4/1943 | Krilow |
| D141,321 | S | 5/1945 | Gallagher |
| 2,440,485 | A | 4/1948 | Ranseen |
| D169,490 | S | 5/1953 | Hug |

(Continued)

FOREIGN PATENT DOCUMENTS

| | | | |
|---|---|---|---|
| DE | 10130178 | A1 | 1/2003 |
| DE | 202009001850 | U1 | 12/2009 |

OTHER PUBLICATIONS

DPx Hest 2.0 Knife Survival Blade, http://www.bladehq.com/item--ESEE-DPx_HEST-Folder--6996, downloaded Sep. 26, 2012.

(Continued)

*Primary Examiner* — David B Thomas

(74) *Attorney, Agent, or Firm* — ARC IP Law, PC; Joseph J. Mayo

(57) ABSTRACT

An identification tag having one or more breakaway tools that may be utilized by uncoupling, or otherwise breaking the tool or tools away from the identification tag to expose a working edge or point for example. Generally includes identification information on the tag along with one or more relatively flat tool including but not limited to one or more knives, saws, screwdrivers, pry bars, can openers, bottle openers, chisels, awls, ice picks, sharpeners or any other relatively flat tool with a working edge or point or any combination thereof.

17 Claims, 9 Drawing Sheets

(56) References Cited

U.S. PATENT DOCUMENTS

| | | | | |
|---|---|---|---|---|
| D169,797 | S | 6/1953 | Wallace | |
| 2,951,482 | A | 9/1960 | Sullivan | |
| D224,388 | S | 7/1972 | Wood | |
| 3,760,438 | A | 9/1973 | White | |
| D230,696 | S | 3/1974 | Evrell et al. | |
| D245,830 | S | 9/1977 | De Gross | |
| 4,300,610 | A * | 11/1981 | China | 206/37.4 |
| 4,363,147 | A | 12/1982 | Deweese | |
| 4,442,559 | A | 4/1984 | Collins | |
| 4,553,279 | A | 11/1985 | Gassew et al. | |
| 4,578,864 | A | 4/1986 | Hoffman | |
| 4,622,707 | A | 11/1986 | Finn | |
| D288,895 | S | 3/1987 | Sarnoff et al. | |
| 4,669,140 | A | 6/1987 | Miceli | |
| 4,817,221 | A | 4/1989 | Ryan | |
| 4,821,356 | A | 4/1989 | Finn | |
| D308,009 | S | 5/1990 | Evrell | |
| 5,259,281 | A | 11/1993 | Burke | |
| 5,328,026 | A * | 7/1994 | Newman | 206/234 |
| D360,815 | S * | 8/1995 | Padden | D8/105 |
| D369,287 | S | 4/1996 | Seber et al. | |
| 5,511,310 | A | 4/1996 | Sessions et al. | |
| D371,289 | S | 7/1996 | Huang | |
| D371,820 | S | 7/1996 | Thompson | |
| D374,388 | S * | 10/1996 | Padden | D8/105 |
| 5,596,808 | A | 1/1997 | Lake et al. | |
| 5,620,090 | A * | 4/1997 | Beeley | 206/234 |
| 5,642,567 | A | 7/1997 | Lin | |
| 5,657,543 | A | 8/1997 | Collins | |
| D383,370 | S | 9/1997 | Chen et al. | |
| D385,471 | S | 10/1997 | Seber et al. | |
| 5,727,319 | A | 3/1998 | Myerchin et al. | |
| 5,727,325 | A | 3/1998 | Mussell | |
| D393,405 | S | 4/1998 | Seber et al. | |
| D398,211 | S | 9/1998 | Howard | |
| 6,009,581 | A | 1/2000 | Davis et al. | |
| 6,009,582 | A | 1/2000 | Harrison et al. | |
| 6,009,584 | A | 1/2000 | Padden | |
| D422,669 | S | 4/2000 | Elishewitz | |
| D425,389 | S | 5/2000 | Elishewitz | |
| 6,085,620 | A | 7/2000 | Anderson et al. | |
| D434,624 | S * | 12/2000 | Padden | D8/42 |
| D435,409 | S | 12/2000 | Roberts | |
| D442,461 | S | 5/2001 | Glesser | |
| D446,571 | S | 8/2001 | Frazer | |
| 6,318,218 | B1 | 11/2001 | Anderson et al. | |
| D452,123 | S | 12/2001 | Kelleghan | |
| 6,347,875 | B1 | 2/2002 | Painsith | |
| D473,917 | S | 4/2003 | Carter | |
| 6,571,940 | B2 * | 6/2003 | Newman | 206/38 |
| 6,574,816 | B2 | 6/2003 | Yu Chen | |
| D479,970 | S | 9/2003 | Hutchinson | |
| 6,782,576 | B1 | 8/2004 | Valencic et al. | |
| D496,425 | S | 9/2004 | Carter | |
| D497,531 | S | 10/2004 | Carter | |
| D508,194 | S | 8/2005 | Carter | |
| 6,957,466 | B2 | 10/2005 | Rivera | |
| D515,654 | S | 2/2006 | Trbovich, Jr. | |
| D519,185 | S | 4/2006 | Carter | |
| D520,825 | S | 5/2006 | Kelleghan | |
| 7,036,174 | B2 * | 5/2006 | Painsith et al. | 7/118 |
| D523,317 | S | 6/2006 | Ryan et al. | |
| D527,788 | S | 9/2006 | Kellgren | |
| D536,593 | S | 2/2007 | Fraga | |
| D553,467 | S | 10/2007 | Ryan | |
| D553,468 | S | 10/2007 | Freeman | |
| 7,302,760 | B2 | 12/2007 | Lake | |
| D563,755 | S | 3/2008 | Wu | |
| 7,337,486 | B2 | 3/2008 | Tsuda et al. | |
| D566,513 | S * | 4/2008 | Marfione | D8/98 |
| 7,360,267 | B2 | 4/2008 | Quenzi | |
| 7,415,745 | B2 | 8/2008 | Rivera | |
| D599,640 | S | 9/2009 | Yang-Fu | |
| D599,641 | S | 9/2009 | Yang-Fu | |
| D600,090 | S | 9/2009 | Yang-Fu | |
| D609,992 | S | 2/2010 | Delaney | |
| 7,676,932 | B2 | 3/2010 | Grice et al. | |
| D614,933 | S | 5/2010 | Freeman | |
| D624,386 | S | 9/2010 | van Deursen | |
| 7,818,843 | B2 | 10/2010 | Kinskey et al. | |
| D632,154 | S | 2/2011 | Yang-Fu | |
| D634,174 | S | 3/2011 | Ryan et al. | |
| 7,913,398 | B2 | 3/2011 | Chu | |
| D639,632 | S | 6/2011 | Freeman et al. | |
| D642,888 | S | 8/2011 | Port et al. | |
| D653,520 | S | 2/2012 | Chang | |
| D654,343 | S | 2/2012 | Wu | |
| D672,841 | S | 12/2012 | Pelton | |
| D672,842 | S | 12/2012 | Pelton | |
| D675,897 | S | 2/2013 | Wu | |
| D677,551 | S | 3/2013 | Pelton | |
| D679,975 | S | 4/2013 | Pelton | |
| 8,464,382 | B2 | 6/2013 | Chu | |
| 2006/0027645 | A1 | 2/2006 | Granick | |
| 2007/0028452 | A1 * | 2/2007 | LaFauci et al. | 30/142 |
| 2007/0245497 | A1 | 10/2007 | Tsuda et al. | |
| 2008/0222895 | A1 | 9/2008 | Marfione et al. | |
| 2008/0271257 | A1 | 11/2008 | Frazer | |
| 2009/0000038 | A1 | 1/2009 | Padden | |
| 2010/0299933 | A1 | 12/2010 | Vellekamp | |
| 2012/0017443 | A1 | 1/2012 | Hao | |
| 2012/0110746 | A1 * | 5/2012 | Allard Serrano et al. | 7/151 |
| 2013/0232793 | A1 * | 9/2013 | Fazal | 30/123 |

OTHER PUBLICATIONS

Sheffield Moab Folding Rescue Knife, http://www.autogeek,net/sheffield-rescue-knife.html, downloaded Sep. 27, 2012.

Ontario Hest Original Fixed Blade. Downloaded from http://www.sears.com/ontario-hest-origina-fixed-blade/p-SPM6596962201?prdNo=2&bl . . . on Nov. 16, 2012.

Microtech Troodon Double Edge OTF Knife, Beadblast Plain Edge, 138-7, BladeOps, LLC, retrieved from http://www.bladeops.com/Microtech-Troodon-Double-Edge-OTF-Knife-BeadBlas-p on Jul. 24, 2012, 2 pages.

CRKT Columbia River Knife and Tool's Exitool 9030 Multi Tool, retrieved from http://www.amazon.com/Columbia-River-Knife-Exitool-9030/dp/B0030IV8TG on Jul, 24, 2012, 6 pages.

Boker Plus Credit Card Knife 2-1/4" Blade, retrieved from http://www.Knifecenter.com on Jul. 24, 2012, 2 pages.

The Original Dog Tag Knife, Titanium Blade, Black Rubber Frame, retrieved from http://www.knifeworks.com/theoriginaldogtagknifetitaniumblade.aspx on Jul. 24, 2012, 4 pages.

Iain Sinclair, CardSharp 2, retrieved from http://iainsinclair.com/products.php on Jul. 24, 2012, 1 page.

SE MT908 11 Function Credit Card Size Survival Pocket Tool, retrieved from http://www.amazon.com/SE-MT908-Function-Credit-Survival/dp/B000Q06LI4 on Jul. 24, 2012, 6 pages.

ICE Companion with Lens/Compass—Translucent, retrieved from http://www.sogshopping.com/tools/icc1-12.html!SID=pp1bedicbg7gm82okgt77lacd6 on Jul. 24, 2012, 1 page.

Survival Card w/ Fire Starter/Compass—Charcoal, retrieved from http://www.toollogic.com/tools/svc1-38.html on Jul. 24, 2012, 1 page.

"Microtech Troodon Double Edge OTF Knife, Beadblast Plain Edge, 138-7" BladeOps, LLC, 2 pages.

CRKT "ExiTool—Designed by Russ Kommer", Columbia River Knife & Tool Inc., 3 pages.

Extended European Patent Search, dated Mar. 15, 2013, 5 pages.

Blackwater Aculus Limited Edition Knife. Http://www.dpxgear.com/shop/aculus-coming-soon.html, Jun. 2, 2013.

* cited by examiner

IDENTIFICATION TAG WITH BREAKAWAY TOOL

This application is a continuation in part of U.S. Utility patent application Ser. No. 13/400,535 filed 20 Feb. 2012, now U.S. Pat. No. 8,707,490, which is a continuation in part of U.S. Utility patent application Ser. No. 13/312,965 filed 6 Dec. 2011 now U.S. Pat. No. 8,695,138, and also claims the benefit of U.S. Provisional Patent Application Ser. No. 61/496,602 filed 14 Jun. 2011, the specifications of which are all hereby incorporated herein by reference.

BACKGROUND OF THE INVENTION

1. Field of the Invention

One or more embodiments of the invention are related to the field of registers of identification as well as the field of tools. More particularly, but not by way of limitation, embodiments of the invention enable an identification tag with breakaway tool, for example one or more tool such as knives, saws, screwdrivers, pry bars, can openers, bottle openers, chisels, awls and ice picks or any other relatively flat tool with a working edge or point or any combination thereof. Embodiments may be constructed from materials that can withstand hostile environments.

2. Description of the Related Art

Registers with identification information are generally utilized to hold information in printed, bar code, magnetic information, electronic chip form. Example registers with identification information include credit cards for example or identification tags for luggage. Known identification tags for luggage for example may include a compartment to hold an identification card and optionally another compartment to hold a small tool or other item. Other identification tags may include "dog tags" that have a plastic border, which when removed exposes a sharp edge on the tag.

Tools that may exist in relatively flat form with a working edge or point include knives, saws, screwdrivers, pry bars, can openers, bottle openers, chisels, awls and ice picks for example. Some existing tools are found in card format, but have sharp exposed edges that form knife blades or other cutting implements for example and must be sheathed or covered to prevent injury.

Knives generally include a long, yet thin blade with a handle. The blade generally includes one cutting edge, and an opposing non-cutting edge. Some knives have cutting edges on both sides of the blade. Knives also are built in folding varieties and generally have a pivot on one or both ends of the handle. However, most knives are non-folding and have one cutting edge. Folding knives are generally more portable and tend to enclose the sharp cutting edge of the knife when folded for safety reasons. Some folding knives include multiple types of blades including saws, can openers, screwdrivers, and other tools, but generally only provide one function per blade or only provide cutting blades that have no other function. Some knives have one or more areas on the blade with serrations, or a saw blade. The serrations may be used to cut through wood or metal for example. Other knives include a variety of tools, generally one per blade in multi-blade holding bodies. The problem with knife blades, serrated edges and pointed tools with handles, for example non-folding knives, is the susceptibility to accidental cutting, either of body parts or other items. Hence, tools with sharp edges or points must be sheathed to cover the dangerous portions of the tool for safety reasons.

Generally, survivalists and military personnel in hostile or hazardous environment carry a multitude of tools. In minimalistic survival scenarios, carrying a multitude of tools is not possible. In such hostile environments, life may depend on having a survival tool such as a knife. May military personal already carry some sort of identification as well, and civilians are known to carry credit cards and other identification tags for example.

There are no known identification tags that break apart to form one or more tools separately. For example, there are no known identification tags that breakaway along a tear line to form one or more knives, saws, screwdrivers, pry bars, can openers, bottle openers, chisels, awls and ice picks. For at least the limitations described above there is a need for an identification tag with breakaway tool.

BRIEF SUMMARY OF THE INVENTION

One or more embodiments described in the specification are related to an identification tag with breakaway tool. The identification tag may include identification information and one or more breakaway tools that may be utilized by uncoupling, or otherwise breaking the tool or tools away from the identification tag to expose a working edge or point for example. The tool or tools may include but are not limited to one or more knives, saws, screwdrivers, pry bars, can openers, bottle openers, chisels, awls and ice picks or any other relatively flat tool with a working edge or point or any combination thereof.

One or more embodiments of the invention generally include a substantially flat material configured to hold identification information wherein the substantially flat material has a first side and a second side that are on opposing sides of the substantially flat material and wherein the substantially flat material has a least a first thickness between the first side and the second side. The substantially flat material may be of uniform thickness, or have raised letters, or compressed or cut-out or partially cut-out, such as is found on a credit card for example, while still maintaining a substantially flat form factor. Any other form factor is in keeping with the spirit of the invention including luggage tags, or any other type of identification apparatus coupled to another object. In one or more embodiments of the invention, the substantially flat material may have one or more thicker portions or areas between the two sides as long as that thickness is less than the height or width of the substantially flat material. For example less than, equal to or thicker than 1 mm, 2 mm, 5 mm, one quarter inch, three-eights of an inch, 1 inch or any other thickness less than, equal to or greater than these dimensions. The first thickness may for example represent the minimum distance between the two sides, not counting any indentations configured to tear or break. The material may have a linear or curvilinear cross section as well, in which case the material includes at least a second thickness, or range of thickness up to the second thickness for example. This enables portions of the tool or identification card to have a stronger portion corresponding to the second thickness, or flat portions orthogonal to the two sides configured to enable manual manipulation for example.

The substantially flat material may be of any shape including rectangular, square, trapezoidal, triangular, circular, elliptical, or any other shape whether straight line segment or curved segment shape or any combination thereof. The substantially flat material may constructed from or include any known material including metal, plastic, glass, materials that include resin, such as composites, or any other material or combination thereof so long as the material is capable of holding identification information and may be configured to decouple into a portion that may be utilized as a tool for example.

One or more embodiments may hold the identification information in printed form, magnetic form or electronic form or in any other form. The printed form information may be in the form of raised, or indented lettering as previously described or visible printing or both. Alternatively, or in combination, the magnetic form of information may be held for example on a magnetic strip that is configured to be read by a magnetic strip reader. Smart cards having electronic chips or other electronic media or memory may also be used alone or in combination to hold the identification information. The identification information may identify a bank account, a person, an address, or identify any other person, place, thing, service, task, or any other item.

Embodiments of the invention also generally include a portion of the substantially flat material configured to physically break the substantially flat material into a first substantially flat portion and a second substantially flat portion. In one or more embodiments, the portion of the substantially flat material configured to physically break is configured with a thickness that is less than the first thickness. This may be in the form of dots or line that are indented into the material for example. Alternatively or in combination, the location to break may include holes, for example in a tear pathway or be of a hardness which differs from the rest of the material to enable tearing or other mechanisms of breakage to occur along a desired path so long as the substantially flat material is configured to physically break into at least two parts.

Embodiments of the invention break into at least two parts wherein the first substantially flat portion includes a tool having a working edge or point or both said working edge and said point. In one or more embodiments, the tool includes a knife having two substantially flat faces and wherein the working edge includes a blade. Alternatively or in combination the working edge or blade may include a serrated edge, or the serrated edge may be on an opposing side of the blade with respect to the working, e.g., sharp edge or cutting edge. One or more embodiments of the tool include a flat non-cutting edge opposite of the working edge. The flat edge enables a finger to press on the flat portion to transfer force to the cutting edge of the blade for example. One or more embodiments of the knife include a first indentation toward the blade that is configured to engage a bottle cap on a top side of the bottle cap with a first portion of the first indentation and configured to engage a bottom edge of the bottle cap with an opposing side of the first indentation to enable removal of the bottle cap. Alternatively, the first or second portion may include a sharp portion enabling the portion to be utilized as a can opener. Any portion of the apparatus, for example an exposed portion after break off, or an outer portion may be hardened, or combined with, or coupled with an object having carbide or plasma coated to enable use as a knife sharpener.

One or more embodiments of the blade may include a second indentation configured to engage a wire to enable lateral angular movement of the blade to break the wire. The indentation enables a wire breaker and is also known as the wire break notch. The wire break notch is situated near the handle and also acts as a "choil" that allows sharpening for the entire blade length. The wire break notch may be aligned to indent towards the bottle cap opener indentation and visa versa so that the top and bottom indentations cooperate in the lashing configuration.

One or more embodiments may implement a tool that includes a knife having two substantially flat faces and wherein the working edge includes a blade and having a flat non-cutting edge opposite of the working edge and wherein the non-cutting edge includes a first indentation toward the blade that is configured to engage a bottle cap on a top side of the bottle cap with a first portion of the first indentation and configured to engage a bottom edge of the bottle cap with an opposing side of the first indentation to enable removal of the bottle cap and wherein the blade comprises a second indentation configured to engage a wire to enable lateral angular movement of the blade to break the wire and wherein the first indentation and second indentation are indented toward one another to enable said blade to be lashed to another object with a line wrapped around the other object and the first indentation and second indentation. This enables the knife to be utilized as a spear, axe or dead drop trap for example when lashing the blade to a pole for example.

One or more embodiments of the tool include a knife having two substantially flat faces and wherein said working edge comprises a blade and having a flat non-cutting edge opposite of the working edge and wherein the non-cutting edge further includes jimping. Jimping slots on the top of the blade near the handle enable thumb contact with the blade that provides better control. The jimping in one or more embodiments is configured to provide a thumb grip on the non-cutting edge wherein the jimping is configured as two or more indentations of different size configured to grip wire insulation of different gauge to enable lateral translation movement of the blade to remove the wire insulation.

One or more embodiments of the tool include a flat section configured as a handle having a long axis and a short axis. Although the examples herein disclose variations of knives, embodiments of the tool may also include any combination of one or more saws, screwdrivers, pry bars, can openers, chisels, awls, ice picks, knife sharpeners.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION OF THE INVENTION

An identification tag with breakaway tool will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
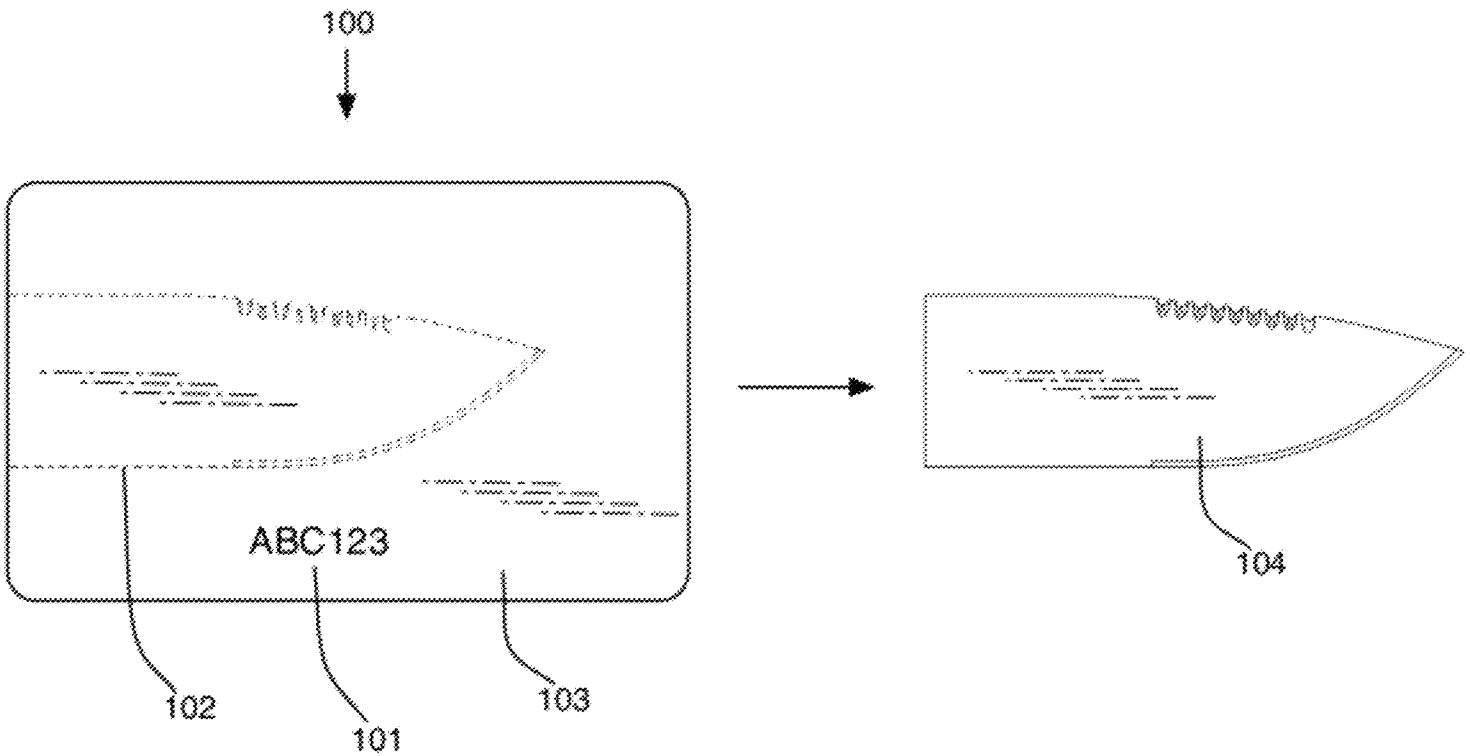
FIG. 1 illustrates an overall view of an embodiment of the invention.

FIG. 1 illustrates an overall view of an embodiment of invention 100. As shown, embodiments of the invention include identification information 101 on an identification tag of a particular material, wherein a portion of the material 102 is configured to physically break the material into two or more portions, namely 103 and at least one tool 104. This enables tool 104 to remain safe while integrally coupled or a part of the apparatus, and until broken away from the second or remaining portion 103. The portion showing a knife along dotted lines 102 may be visible as shown, or may not be visible from the front of the apparatus if the portion of the material configured to enable the apparatus to break does not include holes that extend all the way through the apparatus.

Figure 1A:
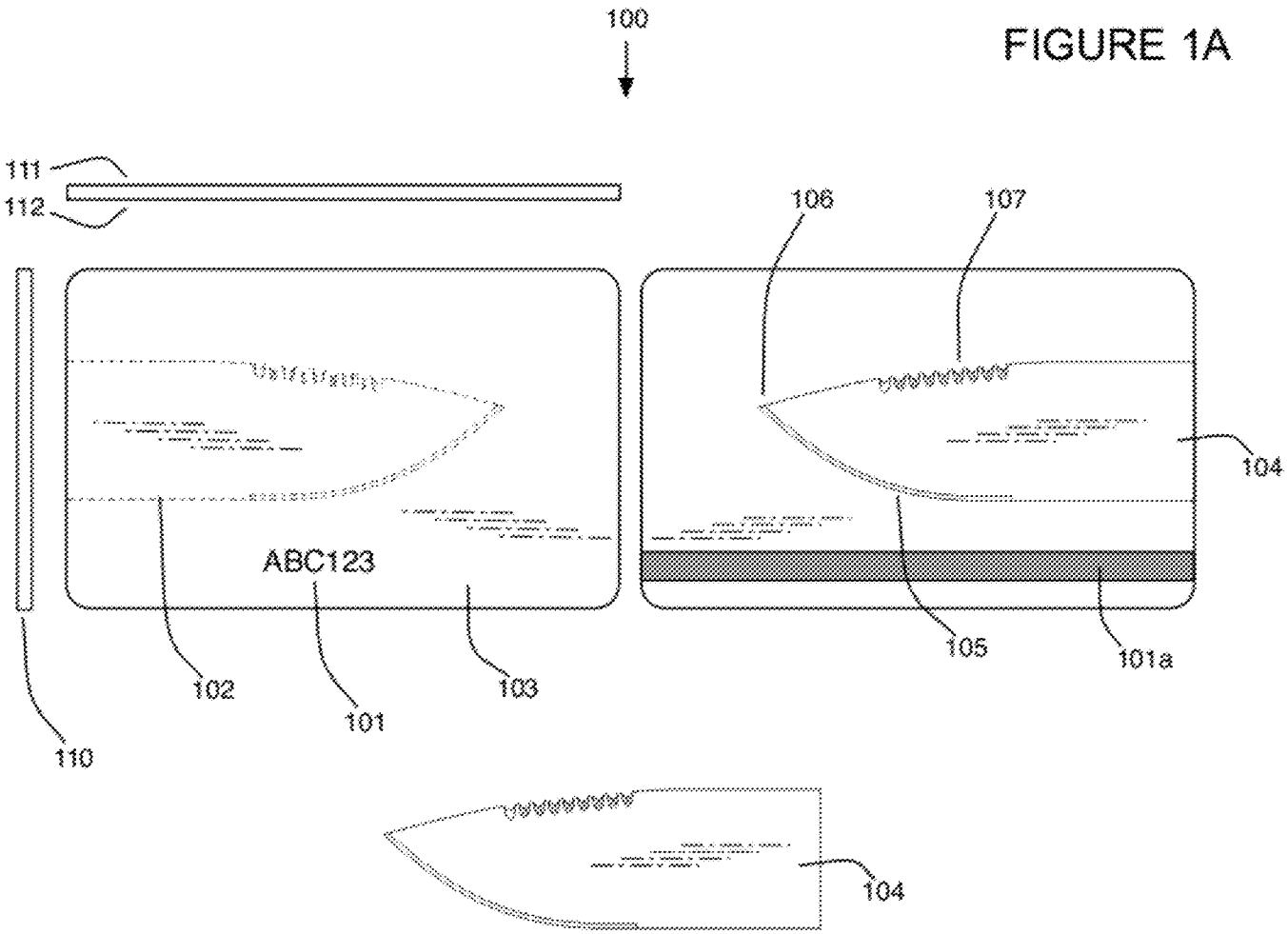
FIG. 1A illustrates a detailed view of an embodiment of the invention.

FIG. 1A illustrates a detailed view of an embodiment of invention 100. The top view is shown in the upper left, the side view is shown on the far left, the front of the apparatus is shown as the left card format embodiment and the rear side of the apparatus is shown on the right of the figure. The tool is shown after breakaway in the bottom of the figure. Embodiments of the invention include a substantially flat material, shown in side view as flat material 110 to hold identification information 101. Although shown as raised letters in horizontal orientation, any orientation and type of lettering may be utilized if desired. For example, the lettering may be cut into or through the apparatus so that it cannot be erased. A portion of the material 102 is configured to physically break the material into two portions, including at least one tool 104 having a working edge 105 or point 106 or both. Embodiments of the invention may also include second working edge 107, for example serrations or another cutting edge or blade for example. The tool or tools may include but are not limited to one or more knives, saws, screwdrivers, pry bars, can openers, bottle openers, chisels, awls, wrenches and ice picks or any other relatively flat tool with a working edge or point or any combination thereof. See FIG. 5 for alternate embodiments of the tools.

Figure 6:
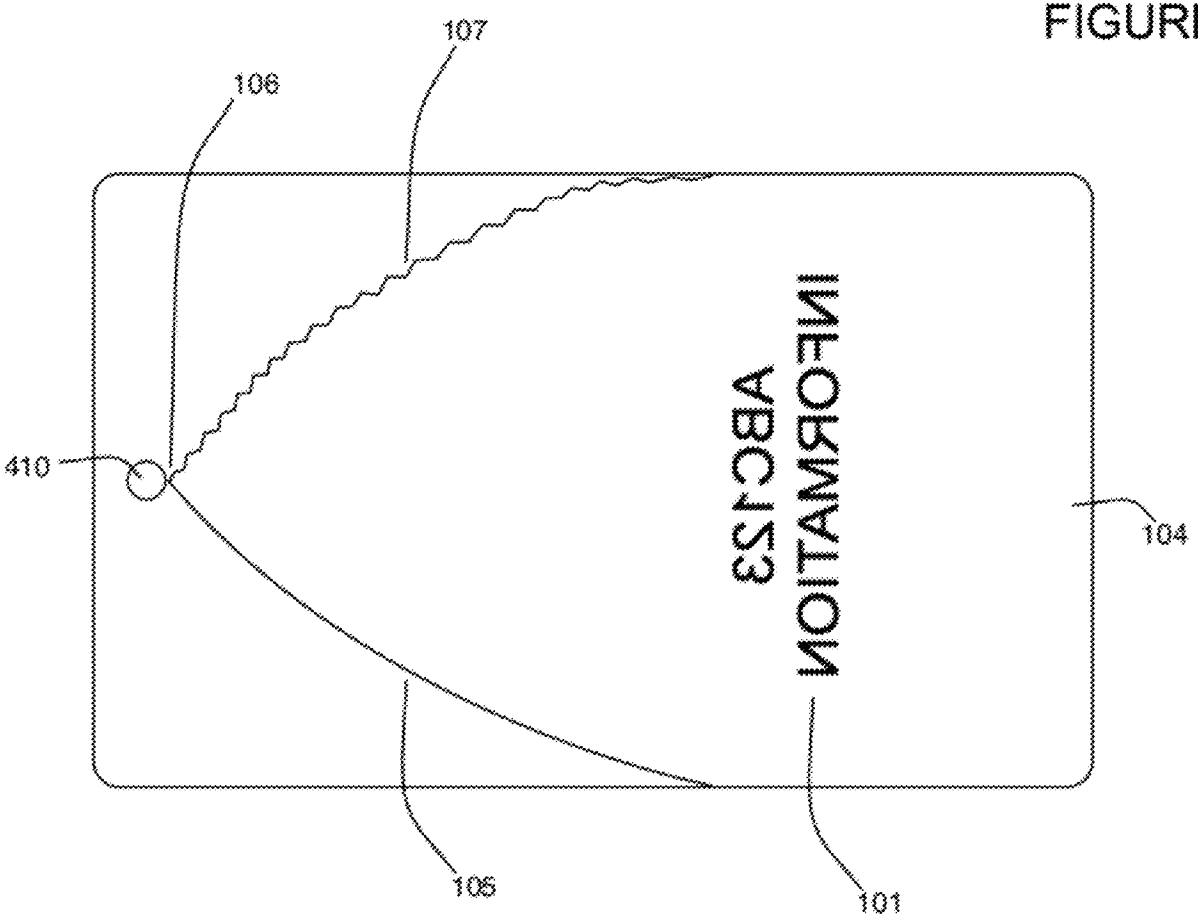
FIG. 6 illustrates a rear view of a fourth embodiment of the invention.
Figure 7:
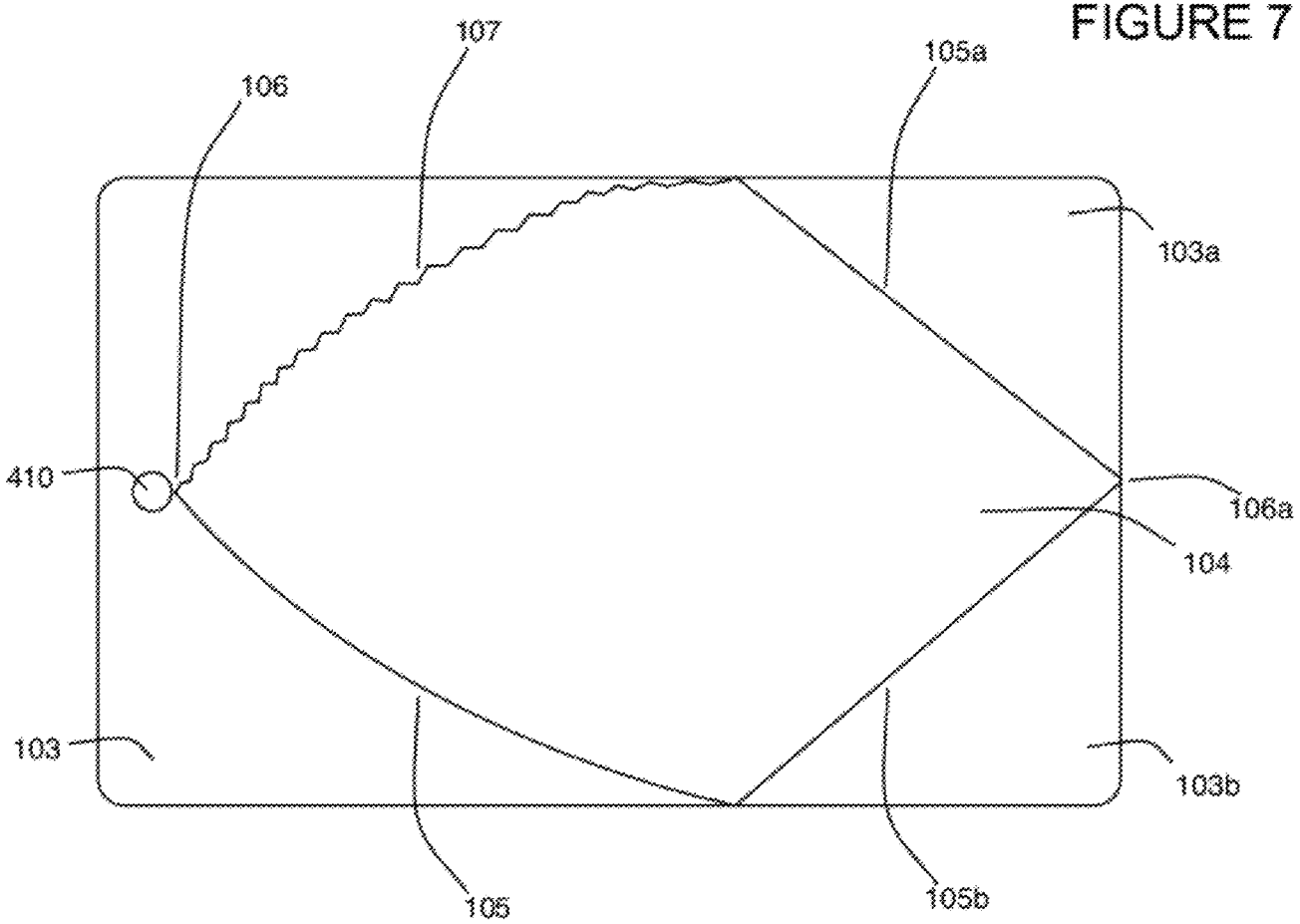
FIG. 7 illustrates a rear view of a fifth embodiment of the invention.

One or more embodiments of the invention generally include a substantially flat material shown as side cross section 110 configured to hold identification information 101 wherein the substantially flat material has first side 111 and second side 112 that are on opposing sides of the substantially flat material and wherein the substantially flat material has a least a first thickness between the first side and the second side. The substantially flat material may be of uniform thickness, or have raised letters, that extend out of identification area 101 for example, such as is found on a credit card for example, while still maintaining a substantially flat form factor. The outer edges of the apparatus may also be utilized for handles as shown in FIGS. 6 and 7.

One or more embodiments may hold the identification information 101 in printed form, for example as shown, or as shown in the rear view on the right side as magnetic form 101*a* or electronic form, for example a chip internal to the card as embodied with a smart card, which is not shown for brevity, or in any other form. The printed form information may be in the form of raised lettering or visible printing or both or as previously discussed, may be cut into or through the apparatus. Alternatively, or in combination, the magnetic form of information may be held for example on a magnetic strip that is configured to be read by a magnetic strip reader. Smart cards having electronic chips or other electronic media or memory may also be used alone or in combination to hold the identification information. The identification information may identify a bank account, a person, an address, or identify any other person, place, thing, service, task, or any other item.

The substantially flat material may be of any shape including rectangular as is shown in FIGS. 1 and 1A, with or without rounded corners for example, or square, trapezoidal, triangular, circular, elliptical, or any other shape (not shown for brevity) whether straight line segment or curved segment shape or any combination thereof as one skilled in the art will appreciate. The substantially flat material may constructed from or include any known material including metal, plastic, or any other material or combination thereof so long as the material is capable of holding identification information and may be configured to decouple into a portion that may be utilized as a tool for example.

Figure 2:
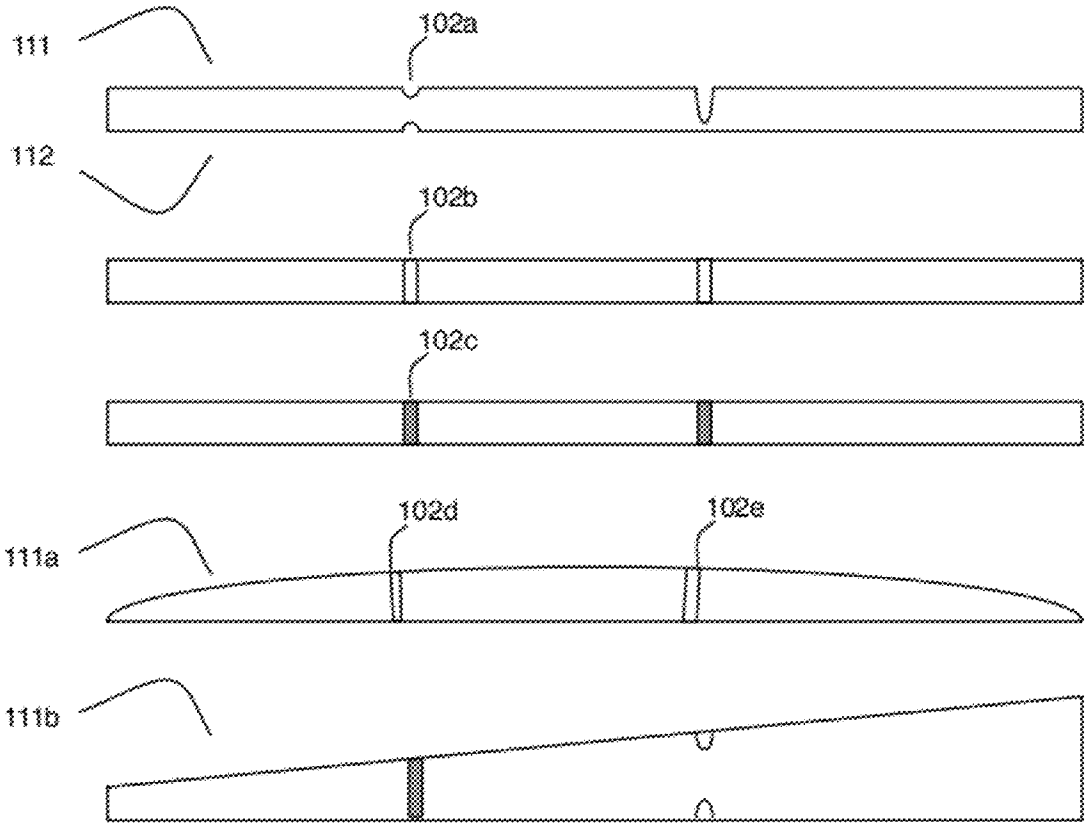
FIG. 2 illustrates side cross sectional views of embodiments of the invention.

FIG. 2 illustrates side cross sectional views of embodiments of the invention. In one or more embodiments of the invention, the substantially flat material may have one or more thicker portions or areas, as shown in the bottom two embodiments, between the two sides as long as that thickness is less than the height or width of the substantially flat material, whether angled or curved. In one or more embodiments, the thickness is much less than the width or height of the flat material, for example the thickness of a credit card. This is not required however and the substantially flat material may vary in thickness or be of a thickness for example greater than a millimeter if desired, or less depending on the material used in construction of the specific embodiment. The first thickness may for example represent the minimum distance between the two sides, not counting any indentations configured to tear or break. The material may have a linear or curvilinear cross section as well, as is shown in fourth embodiment down the page having top 111*a* in which case the material includes at least a second thickness, or range of thickness up to the second thickness for example. This enables portions of the tool or identification card to have a stronger portion corresponding to the second thickness, or flat portions orthogonal to the two sides configured to enable manual manipulation for example. For example the bottommost embodiment is thicker on the right side and than on the left side.

Embodiments of the invention also generally include a portion 102 of the substantially flat material configured to physically break the substantially flat material into a first substantially flat portion and a second substantially flat portion. In one or more embodiments, the portion of the substantially flat material configured to physically break is configured with a thickness that is less than the first thickness as shown at 102*a*, which may be indented on both sides as shown on the left or on one side as shown on the right with a deeper indentation for example. This may be in the form of dots or lines or any combination thereof that are indented into the material for example. Alternatively or in combination, the location to break may include holes 102*b*, for example in a tear pathway or be of a hardness 102*c* which differs from the rest of the material to enable tearing or other mechanisms of breakage to occur along a desired path so long as the substantially flat material is configured to physically break into at least two parts. The indentations or holes may be vertical, spherical or angled in any manner as shown with angled break areas 102*d* and 102*e*. Although break areas 102*d* are shown having a finite width at the bottom, the break areas may angle or otherwise meet at a point at or near the bottom or rear of the apparatus to form extremely sharp edges when the two portions of the apparatus are separated. Angled portions may thus form cutting edges once the tool is decoupled with the other portion of the apparatus and the indentions or angled break areas may extend in any depth including to or nearly to the opposing side to make a sharp cutting edge for example. Any combination of any of the described break areas 102*a-e* or any other mechanism may be utilized in any combination as is shown in the bottommost embodiment that includes indentations and hardness break areas for example.

Figure 3:
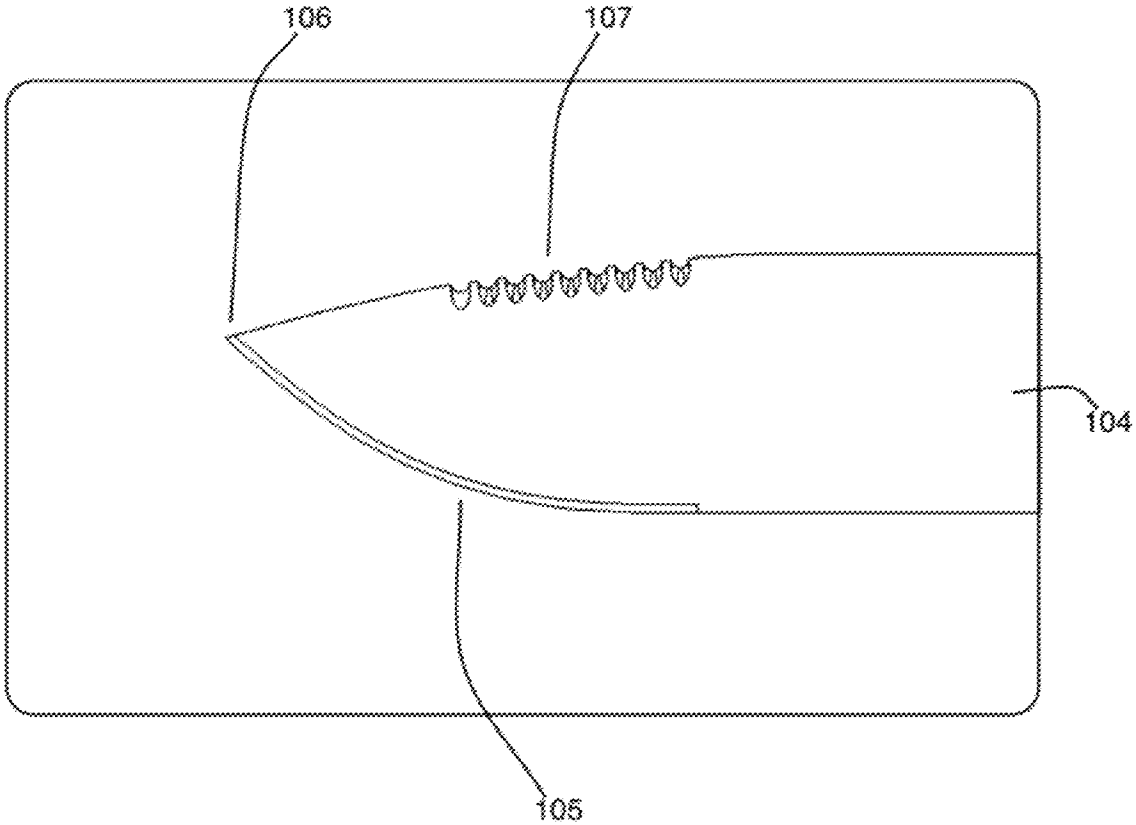
FIG. 3 illustrates a rear view of an embodiment of the invention.

FIG. 3 illustrates a rear view of an embodiment of the invention. Embodiments of the invention break into at least two parts wherein the first substantially flat portion includes a tool having a working edge or point or both the working edge and the point. Generally, the working edge is configured on an inner portion of the apparatus so that a sharp edge is not exposed and hence the identification tag is safe to carry for example. In one or more embodiments, the tool includes a knife having two substantially flat faces and wherein the working edge includes a blade. The right half of tool 104 is shown as two parallel lines that are not formed generally with slanted break areas such as may be utilized to form cutting edge 105. Thus, the right portion of the tool may be utilized as a handle for example. Alternatively or in combination the working edge or blade may include a serrated edge 107, or the serrated edge may be on an opposing side of the blade with respect to the working edge 105, e.g., sharp edge or cutting edge. The serrated edge is optional and may be in the form of flat edge or saw or any other shape for example. If serrated, angled break areas may be utilized to for the sharp portions. In addition, as shown, cylindrical cutouts may be formed to create serrations with extremely sharp edges with a shallow angle with respect to the flat portion of the surface of the apparatus. In addition, as shown cutting edge 105 may also employ linear angled break away portions that angle at a shallow angle to the break away or narrowest point of the apparatus to create an extremely sharp edge. One or more embodiments of the tool include a flat non-cutting edge opposite of the working edge, or for example next to the serrations at the top of the blade. The flat edge enables a finger to press on the flat portion to transfer force to the cutting edge of the blade for example.

Figure 4:
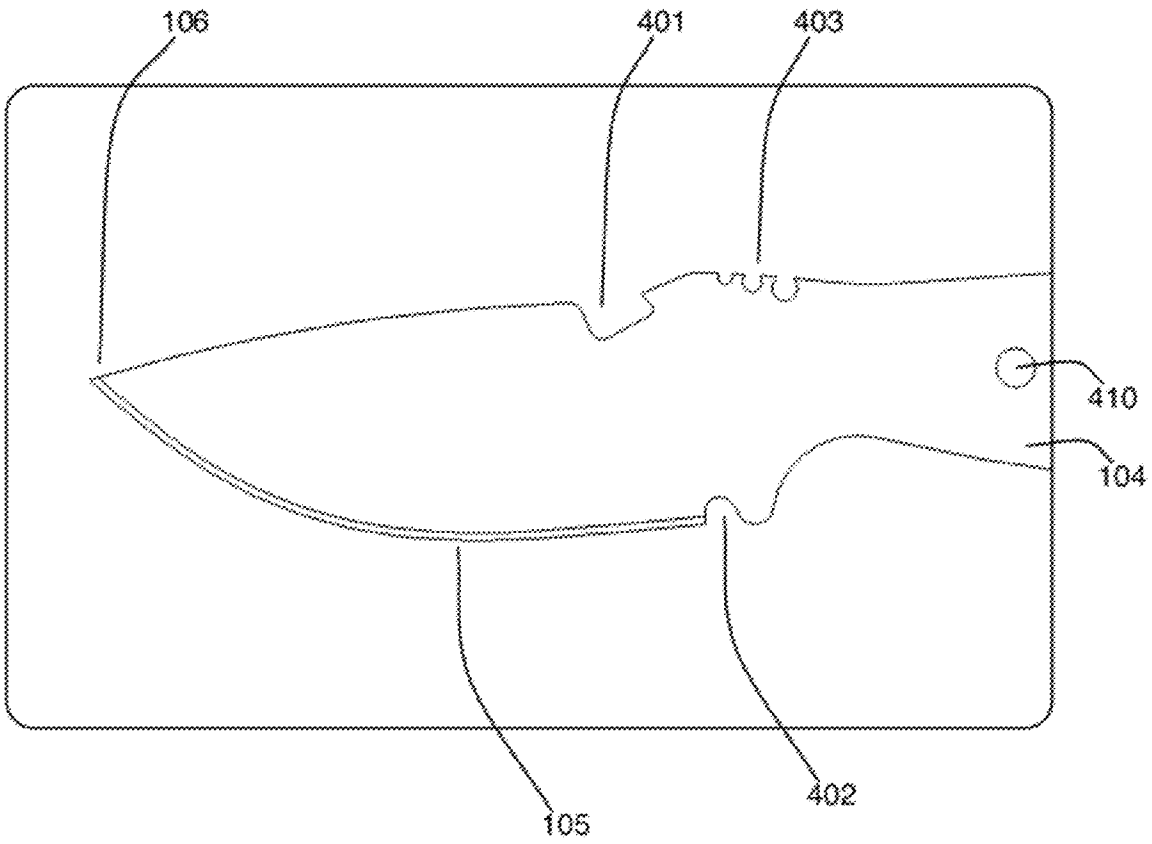
FIG. 4 illustrates a rear view of a second embodiment of the invention.

FIG. 4 illustrates a rear view of a second embodiment of the invention. One or more embodiments of the knife include a first indentation 401 toward the blade that is configured to engage a bottle cap on a top side of the bottle cap with a first portion of the first indentation and configured to engage a bottom edge of the bottle cap with an opposing side of the first indentation to enable removal of the bottle cap. In one or more embodiments of the invention, indentation 401 includes a first and second wall that both slant down and back away from the distal end of the blade, however, the first and second wall may be any shape including linear or curved. The first and second walls meet at the innermost portion of indentation 401. The innermost portion of indentation 401 may also be linear or curved. Generally, the second wall provides a hook like area to pry a bottle cap as the first wall rests on top of the bottle cap. First indentation 401 is configured to engage a bottle cap on a top side of the bottle cap with a first portion of the first indentation, for example the left side of the indentation as shown, and also configured to engage a bottom edge of the bottle cap with an opposing side of the first indentation, for example the right side of the indentation as shown, to enable removal of the bottle cap. The depth of indentations 401 may be any depth deep enough and wide enough to remove a bottle cap. In addition, indentation 4901 may also be utilized as a pot lifter wherein opposing sides of the indentation may be utilized to lift a hot pot by the handle, or on the edge of a pan to lift the pan. In one or more embodiments, the flat top at the non-cutting area may be up to or greater than ⅛ of an inch, or at least 3⁄16 of an inch wide or any other dimension thicker than a standard knife. This enables the knife to be utilized as a wedge or splitter, to split wood for example. The wide flat top may be struck with a hammer or rock for example without breaking the blade.

Alternatively, the first or second portion, which are shown as the left and right sides of the indentation, may include a sharp portion enabling the portion to be utilized as a can opener. One or more embodiments of the blade may include a second indentation 402 configured to engage a wire to enable lateral angular movement of the blade to break the wire. The indentation enables a wire breaker and is also known as the wire break notch. The wire break notch is situated near the handle and also acts as a "choil" that allows sharpening for the entire blade length. The wire break notch may be aligned to indent towards the bottle cap opener indentation and visa versa so that the top and bottom indentations cooperate in the lashing configuration. This enables tool 104 to be utilized as a spear, axe or dead drop trap for example when lashing the blade to a pole for example.

One or more embodiments of the tool may further include jimping 403. Jimping slots on the top of the blade near the handle enable thumb contact with the blade that provides better control. The jimping in one or more embodiments is configured to provide a thumb grip on the non-cutting edge wherein the jimping is configured as two or more indentations of different size configured to grip wire insulation of different gauge to enable lateral translation movement of the blade to remove the wire insulation. One or more embodiments of the apparatus may include a lashing hole 410 or other method of coupling the apparatus to another object. In one or more embodiments, the lashing hole is formed in tool 104, in other embodiments the lashing hole may be in the other portion of the material that holds the identification information, which is not shown for brevity. Alternatively, the other portion and the tool portion may include holes or other coupling devices, as one skilled in the art will appreciate.

Figure 5:
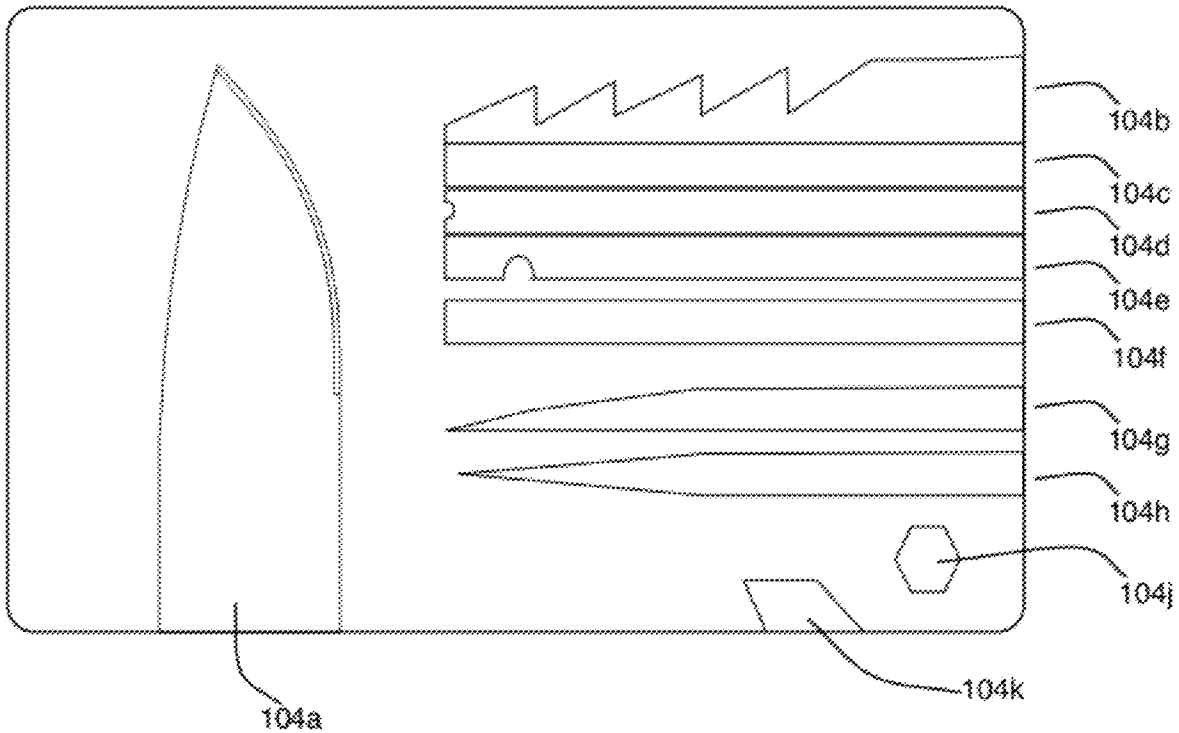
FIG. 5 illustrates a rear view of a third embodiment of the invention.

FIG. 5 illustrates a rear view of a third embodiment of the invention. One or more embodiments of the tool include a flat section configured as handle having a long axis and a short axis for example configured as the area of knife 104*a* away from the tip. Other embodiments shown include handles on the right portions as shown respectively although there is no requirement for any tool to have any type of handle. Embodiments of the tool may also include any combination of at least one saw 104*b*, screwdriver 104*c*, pry bar 104*d*, can opener 104*e*, chisel 104*f*, awl 104*g*, ice pick 104*h*, wrench 104*j*, for example but not limited to a hex nut wrench, or can opener or bottle opener 104*k*. The tools may be contiguous or separated from one another along non-common break areas as desired. Any portion of the apparatus, for example an exposed portion after break off, or an outer portion for example the left side, top or bottom as shown may be hardened, or combined with, or coupled with an object having carbide or plasma coated to enable use as a knife sharpener. In one or more embodiments a side edge of screwdriver 104*c* or any other breakaway tool may also be hardened or contain a hardened object coupled therewith that defines a knife sharpener. In one or more embodiments a facing side or rear side of the substantially flat apparatus may be utilized as a sharpener if that embodiment is hardened for example. In other embodiments of the invention, a cutting edge or non-cutting edge of knife 104*a* may be utilized as a knife or tool sharpener if hard enough for example. One or more embodiments of the invention may include a carbide or other hardened element that for example defines a sharp right angle edge with option concave face that may be utilized to sharpen a knife or other tool at a shallow angle and hone a knife or other tool when drawn over the edge to sharpen at a steeper angle.

FIG. 6 illustrates a rear view of a fourth embodiment of the invention. In one or more embodiments, the tool includes a knife having two substantially flat faces, for example the portions of the apparatus parallel to the plane of the written page, and wherein the working edge includes a blade. Serrated edges in this embodiment may be formed in a more economical manner by utilizing jagged edges cut into the apparatus at a linear slant for example as opposed to more curvilinear embodiments, e.g., as shown in FIG. 3. The right half of tool 104 is shown as two parallel lines that are part of the outer portion of the apparatus, i.e., on the edge of the apparatus. The portions of the apparatus that are configured to break are slanted break areas such as may be utilized to form cutting edge 105. Thus, the right portion of the tool may be utilized as a handle for example. Alternatively or in combination the working edge or blade may include a serrated edge 107, or the serrated edge may be on an opposing side of the blade with respect to the working edge 105, e.g., sharp edge or cutting edge. The serrated edge is optional and may be in the form of flat edge or saw or any other shape for example. If serrated, angled break areas may be utilized to for the sharp portions. One or more embodiments of the tool include a flat non-cutting edge opposite of the working edge, or for example next to the serrations at the top of the blade. The flat edge enables a finger to press on the flat portion to transfer force to the cutting edge of the blade for example. Embodiments of the invention may be less than, equal to or greater than 1 mm in depth, or for example less than, equal to or greater than 2 mm, or one quarter inch, ⅜ of an inch or any other thickness less than the width or height of the apparatus as previously described. Also shown is optional lashing hole, for example as use with an identification tag or luggage tag. Lashing hole 401 may be any shape including circular, oval, rectangular, or any other linear or curvilinear line containing shape. Identification information 101 is shown as cut entirely through the apparatus and in reverse orientation as seen from the rear portion of the apparatus. Alternatively or in combination, any printed identification information may be cut into or all the way through the apparatus or may be in any other form including that of a different material bonded or contained within the tool or other portion of the apparatus.

FIG. 7 illustrates a rear view of a fifth embodiment of the invention. In addition to the portion of the apparatus that remains after tool 104 is broken away, other portions may also be employed. For example, as shown, portions 103*a* and 103*b* may be removed individually to expose a sharp edge 105*a* and 105*b* respectively. If both portions 103*a* and 103*b* are removed, then point 106*a* is exposed. This embodiment allows for one working edge, two working edges and a point, or if tool 104 is also broken away, then two points and up to four working edges, wherein any of the four working edges may be sharp or not. For example, in this embodiment another portion of the substantially flat material is configured to enable the substantially flat material to physically break into at least a third substantially flat portion after a corner of the substantially flat material is broken to expose a second working edge or second point, for example if both corners are broken away.

Figure 8:
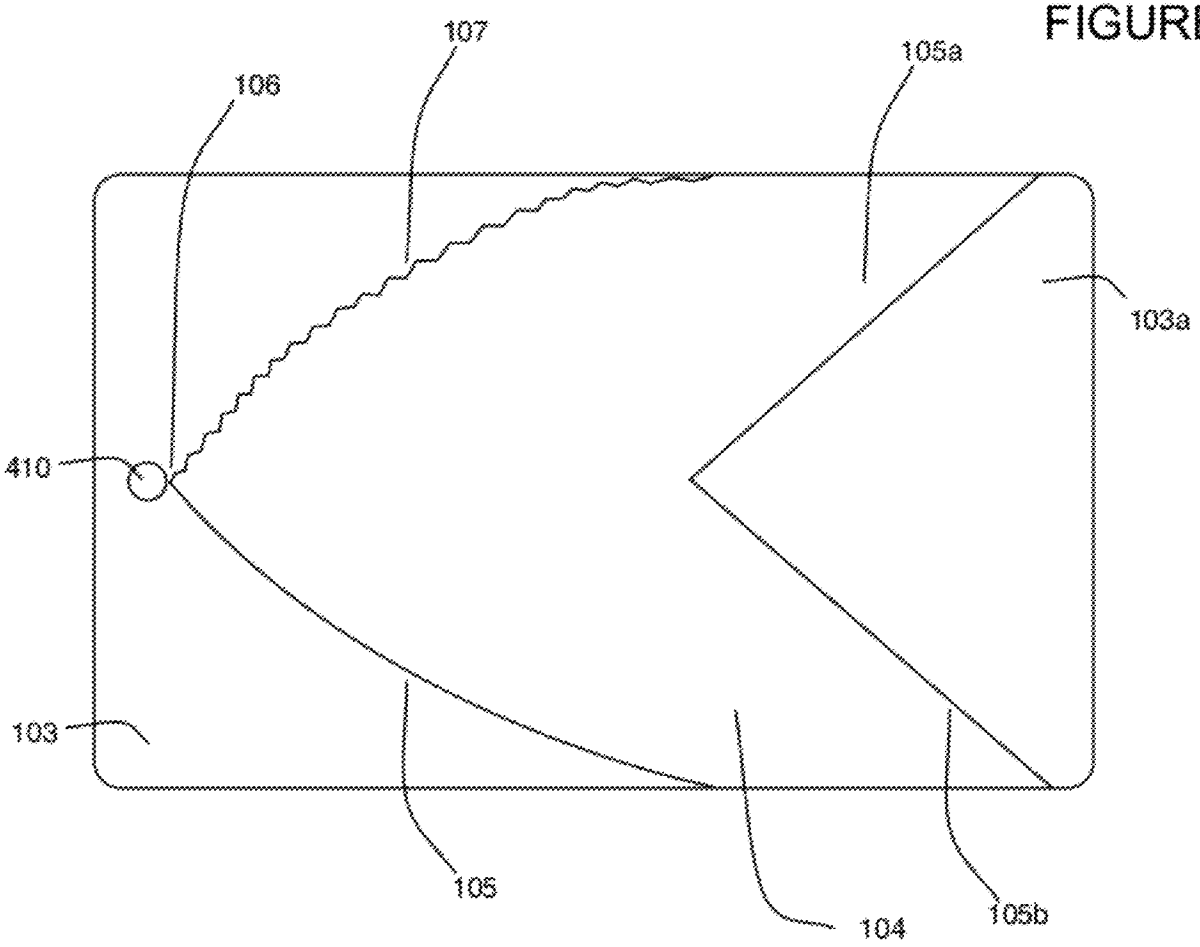
FIG. 8 illustrates a rear view of a sixth embodiment of the invention.

FIG. 8 illustrates a rear view of a sixth embodiment of the invention. In addition to the portion of the apparatus that remains after tool 104 is broken away, other portions may also be employed. For example, as shown, portion 103*a* may be removed individually to expose a sharp edge 105*a* and 105*b* respectively, before or after tool 104 is broken away.

While the invention herein disclosed has been described by means of specific embodiments and applications thereof, numerous modifications and variations could be made thereto by those skilled in the art without departing from the scope of the invention set forth in the claims.

What is claimed is:

1. An identification tag with breakaway tool comprising:

a substantially flat material configured to hold identification information wherein said substantially flat material comprises a first side and a second side that are on opposing sides of said substantially flat material and an outer edge that couples said first side with said second side and wherein said substantially flat material has a least a first thickness between said first side and said second side;

a portion of said substantially flat material configured to enable said substantially flat material to physically break into a first substantially flat portion and a second substantially flat portion;

wherein said first substantially flat portion comprises a tool having a working edge or a point or both said working edge and said point and wherein said working edge or point or both are not located on said outer edge of said substantially flat material and are exposed on an exposed edge of said first substantially flat portion after said substantially flat material is broken into said first and second substantially flat portions; and wherein said tool comprises a knife having two substantially flat faces and wherein said working edge comprises a blade and having a flat non-cutting edge opposite of said working edge and wherein the non-cutting edge comprises jimping configured to provide a thumb grip on the non-cutting edge wherein the limping is configure as two or more indentations of different size configured to grip wire insulation of different gauge to enable lateral translation movement of the blade to remove the wire insulation.

2. The identification tag with breakaway tool of claim 1 wherein said substantially flat material comprises metal, or plastic or glass or composite material or any combination thereof.

3. The identification tag with breakaway tool of claim 1 wherein said substantially flat material is substantially rectangular.

4. The identification tag with breakaway tool of claim 1 wherein said identification information is in printed form or is in magnetic or is in electronic form or any combination thereof.

5. The identification tag with breakaway tool of claim 1 wherein said identification information is visible at least on said first side of said substantially flat material.

6. The identification tag with breakaway tool of claim 1 wherein said portion of said substantially flat material configured to physically break is configured with a thickness that is less than said first thickness.

7. The identification tag with breakaway tool of claim 1 wherein said portion of said substantially flat material configured to physically break is configured with a plurality of holes between said first side and said second side.

8. The identification tag with breakaway tool of claim 1 wherein said portion of said substantially flat material configured to physically break is configured with a hardness that differs from a hardness in another portion of said substantially flat material that is not configured to break.

9. The identification tag with breakaway tool of claim 1 wherein said working edge comprises a serrated edge.

10. The identification tag with breakaway tool of claim 1 wherein the non-cutting edge further comprises a first indentation toward the blade that is configured to engage a bottle cap on a top side of the bottle cap with a first portion of the first indentation and configured to engage a bottom edge of the bottle cap with an opposing side of the first indentation to enable removal of the bottle cap.

11. The identification tag with breakaway tool of claim 1 wherein the blade comprises a second indentation configured to engage said wire to enable lateral angular movement of the blade to break the wire.

12. The identification tag with breakaway tool of claim 1 wherein the non-cutting edge further comprises a first indentation toward the blade that is configured to engage a bottle cap on a top side of the bottle cap with a first portion of the first indentation and configured to engage a bottom edge of the bottle cap with an opposing side of the first indentation to enable removal of the bottle cap and wherein the blade comprises a second indentation configured to engage said wire to enable lateral angular movement of the blade to break the wire and wherein the first indentation and second indentation are indented toward one another to enable said blade to be lashed to another object with a line wrapped around said other object and said first indentation and said second indentation.

13. The identification tag with breakaway tool of claim 1 wherein said tool further comprises a flat section configured as a handle.

14. The identification tag with breakaway tool of claim 1 wherein said tool comprises any combination of one or more saws, screwdrivers, pry bars, can openers, chisels, awls, wrenches, ice picks or sharpeners.

15. The identification tag with breakaway tool of claim 1 wherein said portion of said substantially flat material is further configured to enable said substantially flat material to physically break into at least a third substantially flat portion another portion of said substantially flat material is broken to expose a second working edge or second point.

16. An identification tag with breakaway tool comprising:

a substantially flat material configured to hold identification information wherein said substantially flat material comprises a first side and a second side that are on opposing sides of said substantially flat material and an outer edge that couples said first side with said second side and wherein said substantially flat material has a least a first thickness between said first side and said second side;

a portion of said substantially flat material configured to enable said substantially flat material to physically break into a first substantially flat portion and a second substantially flat portion;

wherein said first substantially flat portion comprises a tool having a working edge or a point or both said working edge and said point and wherein said working edge or point or both are not located on said outer edge of said substantially flat material and are exposed on an exposed edge of said first substantially flat portion after said substantially flat material is broken into said first and second substantially flat portions; and, wherein said tool comprises a knife having two substantially flat faces and wherein said working edge comprises a blade and having a flat non-cutting edge opposite of said working edge and wherein the non-cutting edge comprises a first indentation toward the blade that is configured to engage a bottle cap on a top side of the bottle cap with a first portion of the first indentation and configured to engage a bottom edge of the bottle cap with an opposing side of the first indentation to enable removal of the bottle cap.

17. An identification tag with breakaway tool comprising:

a substantially flat material configured to hold identification information wherein said substantially flat material comprises a first side and a second side that are on opposing sides of said substantially flat material and an outer edge that couples said first side with said second side and wherein said substantially flat material has a least a first thickness between said first side and said second side;

a portion of said substantially flat material configured to enable said substantially flat material to physically break into a first substantially flat portion and a second substantially flat portion;

wherein said first substantially flat portion comprises a tool having a working edge or a point or both said working edge and said point and wherein said working edge or point or both are not located on said outer edge of said substantially flat material and are exposed on an exposed edge of said first substantially flat portion after said substantially flat material is broken into said first and second substantially flat portions; and, wherein said tool comprises a knife having two substantially flat faces and wherein said working edge comprises a blade and having a flat non-cutting edge opposite of said working edge and wherein the blade comprises a second indentation configured to engage a wire to enable lateral angular movement of the blade to break the wire.

* * * * *